United States Patent [19]

Latham

[11] Patent Number: 4,561,145

[45] Date of Patent: Dec. 31, 1985

[54] CONTINUOUS SWEEP FOR ROAD PLANING AND MILLING MACHINES

[76] Inventor: Winchester E. Latham, 10470 W. 21st St., Indianapolis, Ind. 46234

[21] Appl. No.: 580,958

[22] Filed: Feb. 16, 1984

[51] Int. Cl.[4] ..... E01C 23/12

[52] U.S. Cl. ..... 15/340; 15/348; 15/349; 404/91

[58] Field of Search ..... 15/340, 345, 346, 348, 15/349, 347; 404/91

[56] References Cited

U.S. PATENT DOCUMENTS

| | | | |
|---|---|---|---|
| 1,207,816 | 12/1916 | Thompson | 15/346 |
| 1,211,902 | 1/1917 | Warner | 15/346 |
| 1,354,076 | 9/1920 | Stephens | 404/91 |
| 1,459,968 | 6/1923 | Bailly | 15/346 |
| 4,037,981 | 7/1977 | Wirtgen | 404/91 |
| 4,193,159 | 3/1980 | Beard | 15/340 |
| 4,457,043 | 7/1984 | Oeberg et al. | 15/346 X |

*Primary Examiner*—Chris K. Moore

*Attorney, Agent, or Firm*—Barnes & Thornburg

[57] ABSTRACT

An apparatus, to be incorporated into but not limited to a road planer, that would sweep, vacuum material not put onto the existing conveyor by the milling operation, as it now exists. This apparatus would route this material onto the existing conveyors in planing and milling machines. This apparatus may also be added to force feed loaders converting them to street sweepers.

14 Claims, 3 Drawing Figures

CONTINUOUS SWEEP FOR ROAD PLANING AND MILLING MACHINES

The present invention relates generally to roadway construction apparatus, and more particularly, but not by the way of limitation, to an apparatus for resurfacing existing paved roadway. This apparatus added to force feed loaders will convert this equipment to a street sweeping machine.

The subject matter of the present application and prior art is related to subject matter disclosed in Jakob et al U.S. Pat. No. 4,139,318; Ratcliff, Jr. U.S. Pat. No. 4,311,284; and Swisher, Jr. et al U.S. Pat. No. 4,325,580.

In road construction, using the type of road planer or milling machine with cylindrical cutting mandrel, the flighting and cutting bits attached are arranged on the cutting mandrel in such a manner that the milled material is directed to the center of the mandrel and the material is then directed to conveyors or other apparatus that would place the milled material into trucks, material crushers, pavers or other apparatus designed to handle milled material.

In municipalities where street sweeping is becoming required more and more all the time, this apparatus may be added to existing force feed loaders. In this way, equipment may become multipurpose and work more effectively.

In the present method of road planing and milling of paved roadways, all material is not picked up by the cutting or milling action and placed on the conveyors or other apparatus to move the milled material from the road surface planed to trucks, crushers, or other machines for handling the milled material. In the milling of the roadway surface, the action of the equipment, trucks or traffic will repack milled material left in place requiring the use of street brooms or sweepers. The repacked material or material left by the milling operation defeats the original purpose of the milling operation, which is to bring the road bed to a predefined grade. It is therefore important that this material be removed from the milled road surface as quickly as possible.

In use, contractors would use various types of brooms and street sweepers after the planar or milling machine. This operation of clean up requires additional equipment and manpower for the milling operation; adding to the cost of the milling or planing operation.

The present invention provides apparatus to be added to the existing planing machines or force feed loaders. On the planing machine; this apparatus would be placed behind the cutting mandrel; picking up any planed material not directed by the cutting mandrel to the conveyors or other apparatus for removing milled material from the road surface.

On force feed loaders, this apparatus would be placed in front of the augers, producing a street sweeper that is capable of loading directly into trucks.

Brooms would direct material that is left on the roadway to the opening of the apparatus. A vacuum would be created with the use of a hydraulically operated fan. Material would be picked up by this vacuum, pulled through the vacuum line, and dropped into a hopper, which would be added to the existing machines. The bottom of this hopper would be fixed with a rotary valve type opening that would allow any material in the bottom of the hopper to pass through the hopper but yet not allow the vacuum created in the hopper to be lost.

The rotary valve opening would be fixed in such a manner that the material picked up by this apparatus would be dropped onto the existing conveyors of the planing or milling machines and force feed type loaders.

Additional features and advantages of the invention will become apparent to those skilled in the art upon consideration of the following detailed description of the preferred embodiment exemplifying the best mode of carrying out the invention as presently perceived. The detailed description particularly refers to the accompanying figures in which:

FIG. 2 is a sectional view of the continuous sweep apparatus.

Figure 1:
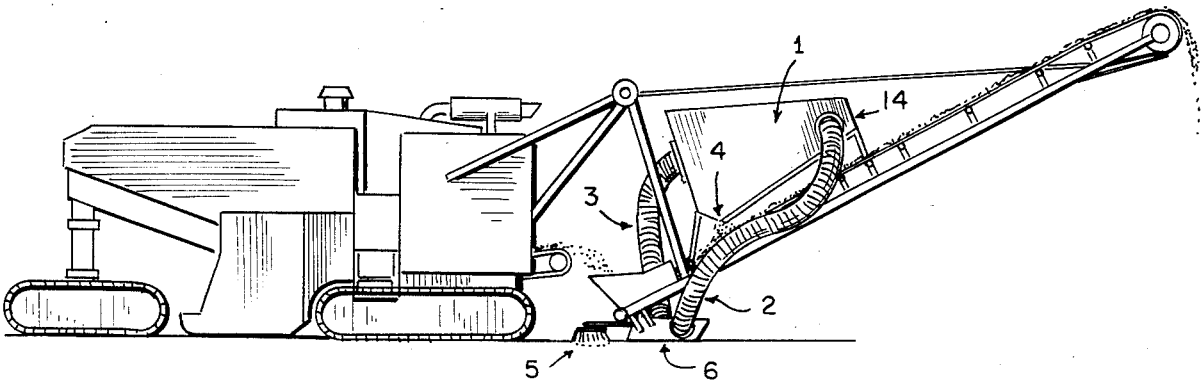
FIG. 1 shows a view of the apparatus as it would be placed on existing planing and milling machines or forced feed type loaders. In this figure, it is a rear loading type.
Figure 2:
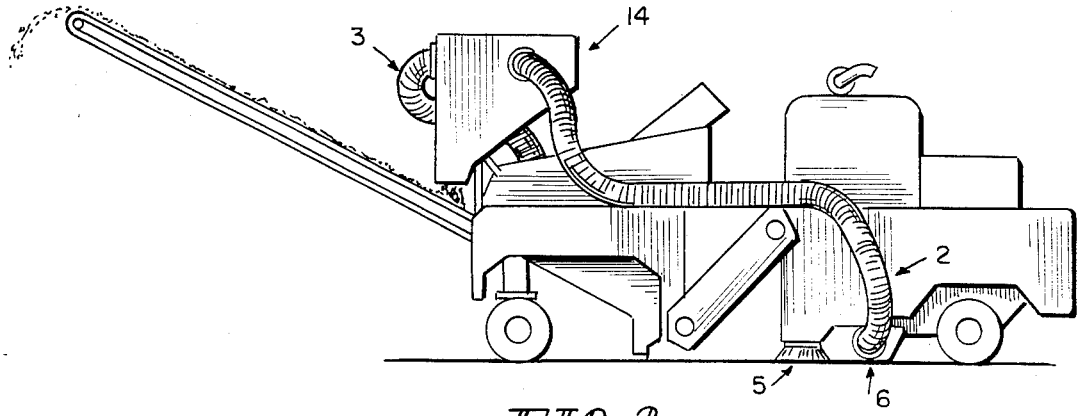
FIG. 2 is a view of the apparatus placed in a front loading type machine.
Figure 3:
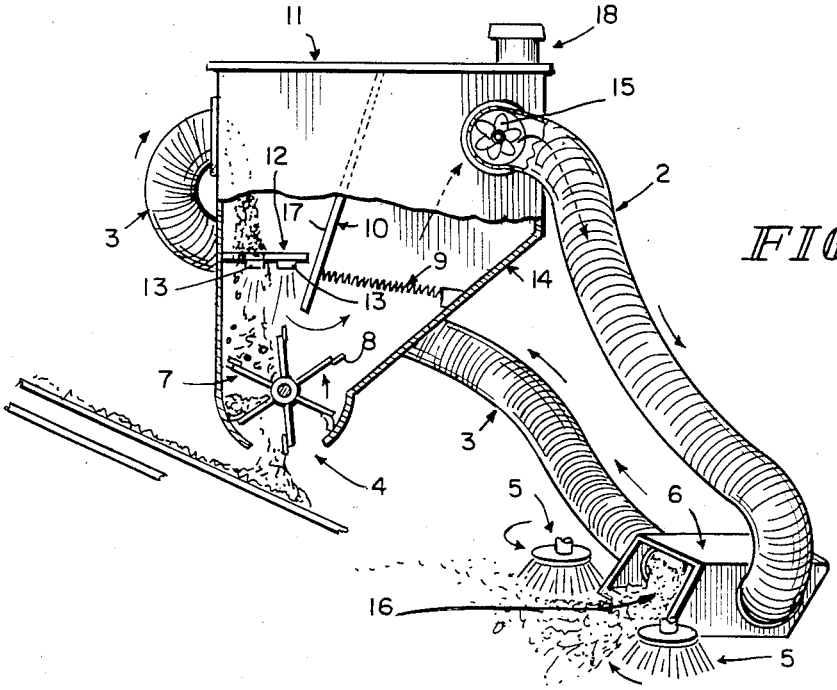

Brooms 5 would be placed directly behind the cutting mandrel or in front of the augers on a force feed type loader. The brooms 5 would be revolving toward each other; removing the material from the roadway and directing it to the opening 16 of the collection pan 6. The material would be picked up by the vacuum created by the hydraulically powered fan 15 and pulled through the vacuum line 3 into the hopper 14. The weight of the material would cause it to fall into the bottom of the hopper.

The top 11 of the apparatus is removable for easy cleaning and inspection of the fan 15 and spray system 12 in the hopper.

On the inside of the hopper, a baffle 10 is set at an angle that would direct the air flow through the hopper; causing the material to pass by a water spray bar 12 that is fixed with a plurality of spray nozzles 13. This water mist would cause a fall out of dust particles and help to eliminate any dust particles from traveling out through the exhaust line 2 with the air flow. Also, this water mist would serve to lubricate the hard rubber tips 8 of the rotary valve in the bottom of the hopper.

At the top of the hopper, an adjustable opening 18 with air filter would allow for the release of excess air to keep the vacuum built up.

A spring 9 attached to the lower portion of the baffle 10 would allow vibration on the baffle to help remove particles and material build up. The baffle would be fixed with a removal hard face wear plate 17. This plate would take the initial abrasiveness of the material as it enters the hopper.

The rotary valve 7 in the bottom of the hopper 14 would be equipped with fins edged with a pliable material that would act as a seal, maintaining the vacuum required for the pick-up of material. The rotary valve 7 would be powered in such a way to open and conduct the material to the outside opening 4 of the rotary valve 7. The outside opening 4 of the rotary valve 7 would be placed in such a manner that the material leaving the hopper would be placed on the existing conveyors.

Although the invention has been described in detail with reference to preferred embodiments, variations and modifications exist within the scope and spirit of the invention as described and as claimed in the following claims.

What is claimed is:

1. A sweeper apparatus for use with a mobile roadway cleaning vehicle or the like, the mobile roadway cleaning vehicle including pick-up means for gathering a portion of loose material spread on a roadway or other surface in the path of the vehicle, and conveyor means for transporting a stream of the loose material gathered by the pick-up means to a point of reclamation, the sweeper apparatus comprising sweeper means for collecting an additional portion of the loose material spread on the roadway, the sweeper means being fixed to the mobile roadway cleaning vehicle to follow behind the pick-up means during operational movement of the vehicle so that substantially the remaining portion of loose material spread on the roadway in the path of the vehicle is removed from the roadway, and hopper means for dispensing the additional portion of the loose material collected from the road surface by the sweeper means onto the stream of loose material transported on the conveyor means prior to arrival of the stream at its point of reclamation so that the portion of the loose material gathered by the pick-up means and the additional portion of the loose material collected by the following sweeper means are combined on the conveyor means prior to delivery to the point of reclamation.

2. The sweeper apparatus of claim 1, wherein the sweeper means includes a collection pan formed to include an opening for receiving loose material therethrough, and broom means for removing loose material from the roadway and for directing it toward the collection pan opening.

3. The sweeper appratus of claim 2, wherein the collection pan is mounted to the conveyor means to position the collection pan opening in close proximity to the roadway so that loose material spread on the roadway is swept easily into the collection pan via the opening due to operation of the broom means.

4. The sweeper apparatus of claim 2, wherein the broom means includes a pair of rotatable brushes positioned to sweep the roadway, and means for rotating one of the rotatable brushes in a clockwise direction and the other of the rotatable brushes in a counterclockwise direction to sweep substantially all of the loose material not gathered by the pick-up means toward the collection pan opening.

5. The sweeper apparatus of claim 4, wherein the pair of rotatable brushes are mounted to one of the mobile roadway cleaning vehicle and the collection pan in spaced-apart relation adjacent the collection pan opening.

6. The sweeper apparatus of claim 2 wherein the hopper means includes a hollow chamber formed to include an inlet opening and a spaced-apart dispensing opening, first tube means for conducting loose material from the collection pan into the hollow chamber via the inlet opening, vacuum means for applying a vacuum to the hollow chamber to draw loose material from the collection pan into the hollow chamber via the first means for subsequent discharge, and valve means for discharging a series of metered quantities of loose material from the hollow chamber onto the stream of loose material transported on the conveyor means while maintaining the vacuum in the hollow chamber.

7. The sweeper apparatus of claim 6, wherein the hollow chamber includes a funnel-shaped side wall terminating at the dispensing opening so that loose material introduced into the hollow chamber via the inlet will be funneled toward the dispensing opening due to gravitational forces acting thereon.

8. The sweeper apparatus of claim 7, wherein the hopper means further includes atomizer means for spraying a liquid onto loose material in the hollow chamber to reduce the amount of airborne dust within the hollow chamber, the atomizer means being positioned within the hollow chamber intermediate the inlet and the dispensing opening.

9. The sweeper means of claim 7, wherein the hollow chamber further includes a top member attached to a top edge of the funnel-shaped side wall opposite the dispensing opening, and the hopper means further includes baffle means for directing loose material toward the dispensing outlet after it has been introduced into the hollow chamber via V inlet.

10. The sweeper apparatus of claim 9 wherein the hopper means further includes atomizer means for spraying a liquid onto the loose material in the hollow chamber to reduce the amount of airborne dust within the hollow chamber, the atomizer means including an atomizer bar having one end coupled to the funnel-shaped side wall and the other end coupled to the baffle means, at least one spray nozzle fixed to the atomizer bar, and means for conducting liquid to the at least one spray nozzle.

11. The sweeper apparatus of claim 9, wherein the baffle means includes a shield for deflecting loose material drawn into the hollow chamber toward the dispensing outlet, the shield having proximal and distal ends, means for pivotally mounting the proximal end of the shield to the top member, the spring means for yieldably supporting the distal end of the shield to permit the shield to vibrate during operation of the vacuum means to aid removal of loose material from the shield.

12. The apparatus of claim 6, wherein the valve means includes a rotary valve having an axis of rotation and a plurality of fins extending outwardly from the rotary valve in the direction perpendicular to the axis of rotation, means for mounting the rotary valve in the bottom of the hollow chamber in proximity to the dispensing outlet for rotational movement about the axis of rotation to place the rotatable fins intermediate the inlet and the dispensing opening in the path of the loose material to collect loose material in a series of compartments formed by adjacent fins so that the amount of loose material discharged through the dispensing outlet onto the conveyor means is metered by sequential emptying of the series of compartments during rotation of the rotary valve.

13. The sweeper apparatus of claim 12, wherein each fin includes means for pliably engaging the funnel-shaped side wall to maintain the vacuum applied to the hollow chamber during rotation of the rotary valve.

14. The sweeper apparatus of claim 6, wherein the hollow chamber is formed to include a return outlet, the collection pan is formed to include a return inlet, and further comprising second tube means for conducting airborne dust or the like from the hollow chamber into the collection pan via the return inlet so that such airborne dust is returned to the collection pan and recycled for discharge through the dispensing opening onto the conveyor means.

* * * * *

UNITED STATES PATENT AND TRADEMARK OFFICE

CERTIFICATE OF CORRECTION

PATENT NO. : 4,561,145

DATED : December 31, 1985

INVENTOR(S) : Winchester E. Latham

It is certified that error appears in the above-identified patent and that said Letters Patent is hereby corrected as shown below:

Claim 3, line 1, "appratus" should read --apparatus--.

Claim 6, line 10, after "first" insert --tube--.

Claim 9, line 8, "V" should read --the--.

Signed and Sealed this

Seventeenth Day of January, 1989

*Attest:*

DONALD J. QUIGG

*Attesting Officer*

*Commissioner of Patents and Trademarks*